US009377035B2

(12) United States Patent
Gaarder et al.

(10) Patent No.: US 9,377,035 B2
(45) Date of Patent: Jun. 28, 2016

(54) WIRELESS PNEUMATIC CONTROLLER

(75) Inventors: Barry Lynn Gaarder, Marshalltown, IA (US); Scott Richard Kratzer, Marshalltown, IA (US)

(73) Assignee: FISHER CONTROLS INTERNATIONAL LLC, Marshalltown, IA (US)

( * ) Notice: Subject to any disclaimer, the term of this patent is extended or adjusted under 35 U.S.C. 154(b) by 1077 days.

(21) Appl. No.: 13/223,675

(22) Filed: Sep. 1, 2011

(65) Prior Publication Data

US 2013/0055885 A1 Mar. 7, 2013

(51) Int. Cl.

| | |
|---|---|
| ***F15B 21/08*** | (2006.01) |
| ***F15B 13/08*** | (2006.01) |
| *F15B 15/28* | (2006.01) |
| *F15B 15/20* | (2006.01) |

(52) U.S. Cl.

CPC ..... *F15B 13/0846* (2013.01); *F15B 21/08* (2013.01); *F15B 15/202* (2013.01); *F15B 15/28* (2013.01)

(58) Field of Classification Search

CPC ..... F15B 21/003; F15B 21/001; F15B 21/08; F15B 13/0846; F15B 15/202; F15B 9/09

USPC ..... 60/706; 91/363 R, 527

See application file for complete search history.

(56) References Cited

U.S. PATENT DOCUMENTS

| | | | | |
|---|---|---|---|---|
| 4,815,496 | A * | 3/1989 | Nishitani | F15B 13/0814 137/271 |
| 5,845,544 | A * | 12/1998 | Huggins et al. | 74/606 R |
| 5,988,765 | A * | 11/1999 | Yamaguchi | B60T 8/3235 303/22.6 |
| 6,374,153 | B1 * | 4/2002 | Brandt et al. | 700/188 |
| 2002/0154466 | A1 * | 10/2002 | Morino | H01H 35/24 361/211 |
| 2007/0159161 | A1 * | 7/2007 | Neill | 324/158.1 |
| 2008/0288151 | A1 * | 11/2008 | Goebels et al. | 701/78 |

FOREIGN PATENT DOCUMENTS

| | | | | |
|---|---|---|---|---|
| CA | 2105705 | A1 * | 3/1994 | F15B 13/0405 |
| DE | 10128447 | | 1/2003 | |
| DE | 10128448 | | 1/2003 | |
| GB | 2448028 | | 10/2008 | |
| GB | 2448028 | A * | 10/2008 | |

OTHER PUBLICATIONS

Patent Cooperation Treaty, "International Search Report," issued by the International Searching Authority in connection with PCT application No. PCT/US2012/053343, on Jan. 16, 2013 (2 pages).

Patent Cooperation Treaty, "Written Opinion of the International Searching Authority," issued by the International Searching Authority in connection with PCT/US2012/053343, on Jan. 16, 2013 (6 pages).

* cited by examiner

*Primary Examiner* — Michael Leslie

*Assistant Examiner* — Abiy Teka

(74) *Attorney, Agent, or Firm* — Hanley, Flight & Zimmerman, LLC

(57) ABSTRACT

A pneumatic controller described herein includes a housing to be connected to an actuator. The housing contains a position monitor with a wireless communication interface. The pneumatic controller also includes a pneumatic control module to be joined to the housing and operatively coupled to the actuator.

19 Claims, 5 Drawing Sheets

WIRELESS PNEUMATIC CONTROLLER

FIELD OF THE DISCLOSURE

The present disclosure relates generally to pneumatic actuator controls and, more particularly, to a wireless pneumatic controller to monitor and control pneumatic actuators.

BACKGROUND

Valves are commonly used in process control systems to manipulate a flow of fluid. The operation of the valves is typically controlled, at least in part, via a process control device such as, for example, a positioner. The positioner may be operatively coupled to an actuator assembly, for example, a sliding stem actuator, that is mechanically coupled to the valve. In some cases, valve actuators may provide special mounting holes, plates, or the like that are, for example, integral to or attached to the yoke of the actuator to enable the positioner to be mounted to the actuator assembly.

In some cases, wireless position monitors are mounted to the valve/actuator assembly to monitor the position of the valve and provide a wireless feedback signal to indicate the position of the actuator assembly. However, to control the actuator assembly using position information collected by a wireless position monitor, additional equipment, components, and connections are required.

SUMMARY

An example pneumatic controller includes a housing to be connected to an actuator. The housing contains a position monitor with a wireless communication interface. The example pneumatic controller includes a pneumatic control module to be joined to the housing and operatively coupled to the actuator.

An example pneumatic control module includes a pneumatic converter to be operatively coupled to a position monitor that has a wireless communication interface. The example pneumatic control module includes a pneumatic amplifier to be operatively coupled to an actuator and a control module base to operatively couple the pneumatic converter and the pneumatic amplifier.

An example position monitor includes a housing to be connected to an actuator. An opening in the housing is to accept a pneumatic control module. The example position monitor includes a wireless communication interface.

An example pneumatic controller includes a housing to be operatively coupled to an actuator. The example pneumatic controller includes a position monitor that is contained within the housing and which has a wireless communication interface. The example pneumatic controller includes a pneumatic control module that is contained within the housing and which is operatively coupled to the position monitor.

DETAILED DESCRIPTION

In general, the example wireless pneumatic controller described herein may be operatively coupled to an actuator to provide wireless valve position monitoring and pneumatic control of a valve and actuator assembly. More specifically, the example wireless pneumatic controller described herein may monitor a valve and/or valve actuator position and may convey valve and/or valve actuator position information to a control system for processing. The control system may then process the position information (e.g., to determine whether the valve should be opened/closed further based on a desired control point) and return appropriate commands to the wireless pneumatic controller. The wireless pneumatic controller may process these commands to generate a pneumatic signal that may be used to control the actuator assembly in accordance with the commands sent by the control system. Thus, an actuator control system utilizing the example wireless pneumatic controller described herein requires only one device mounted to the actuator/valve assembly in communication with a control system to monitor and control a position of the actuator assembly.

Additionally, the example wireless pneumatic controller described herein enables the pneumatic controller to be converted from a wireless pneumatic controller to a wireless position monitor to suit the needs of a particular application. The modularity of the example wireless pneumatic controller also enables a pneumatic control module to be separated from the valve and actuator assembly for easy maintenance or service of the pneumatic controller.

Figure 1:
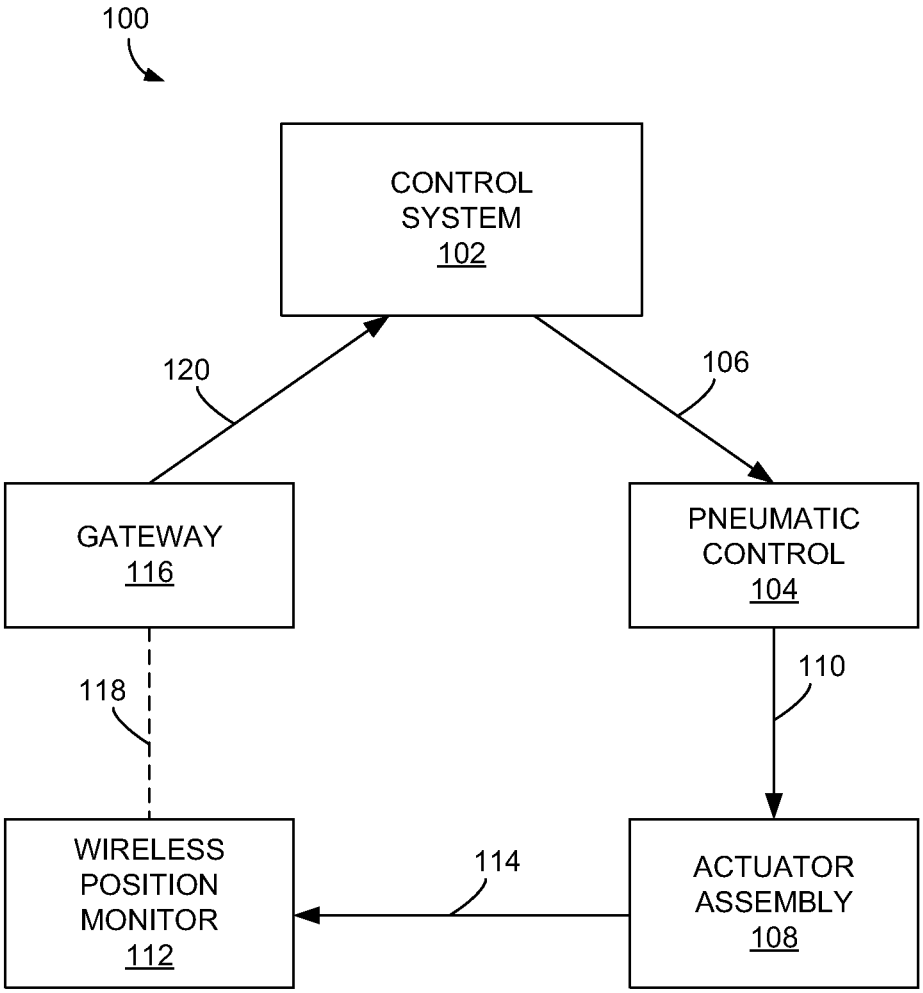
FIG. 1 PRIOR ART
FIG. 1 illustrates an example block diagram of a known actuator control system.

Before describing the example wireless pneumatic controller in detail, a brief description of an example known actuator control system 100 is provided below in connection with FIG. 1. As depicted in FIG. 1, the actuator control system 100 includes a control system 102. The control system 102 communicates with (e.g., sends commands to) a pneumatic control 104 via a wired communication path or link 106. The pneumatic control 104 controls an actuator assembly 108 via a pneumatic signal 110. As the actuator assembly 108 operates, a wireless position monitor 112 monitors a position of the actuator assembly 108. For example, the wireless position monitor 112 receives a feedback signal 114 indicating the position of the actuator assembly 108. The wireless position monitor 112 communicates the position information to a gateway 116 via a wireless communication link 118. The position information is then communicated from the gateway 116 to the control system 102 via a wired path or link 120.

In the example known actuator control system 100 of FIG. 1, to control the actuator assembly 108 based on the position information received by the wireless position monitor 112, the control system 102 utilizes the pneumatic control 104, which is connected to the actuator assembly 108 and separate from the wireless position monitor 112. Thus, the wireless position monitor 112 is only capable of collecting and relaying position information and, accordingly, is incapable of directly controlling the actuator assembly 108.

Figure 2:
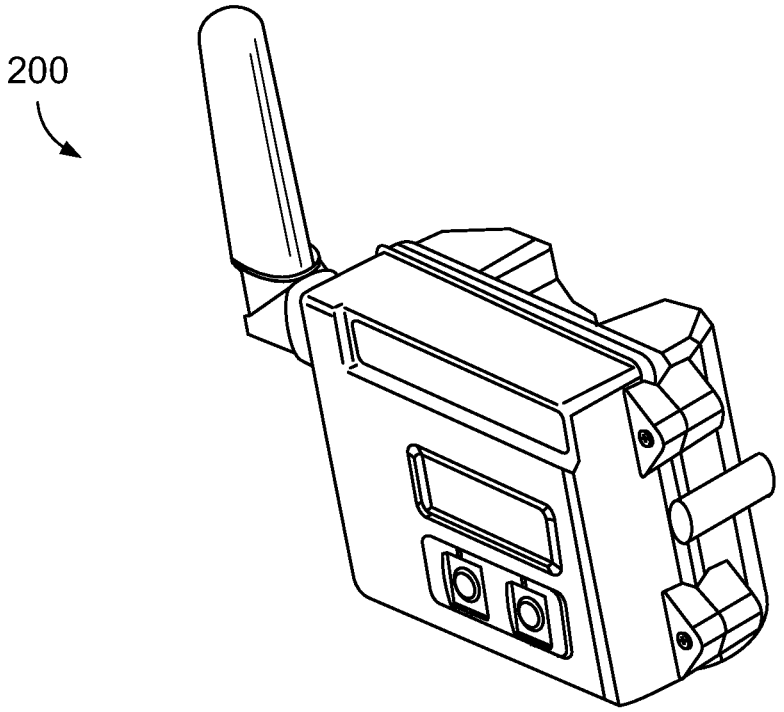
FIG. 2 PRIOR ART
FIG. 2 illustrates an example of a known wireless position monitor that may be used in connection with the control system of FIG. 1.

FIG. 2 illustrates an example of a known wireless position monitor 200 that may be used in connection with the example actuator control system 100 of FIG. 1. The example wireless position monitor 200 may be, for example, a Fisher® Type 4300 Series Position Monitor. The wireless position monitor 200 may be operatively coupled to an actuator assembly, for example, the actuator assembly 108 of FIG. 1, to receive and wirelessly transmit position information of the actuator assembly 108 to a control system, for example, the control system 102 of FIG. 1. The example wireless position monitor 200 may be mounted on, for example, a rotary valve or a sliding stem valve to collect valve position information.

The example wireless position monitor 200 may collect and wirelessly transmit position information of the actuator assembly 108 to the control system 102. The control system 102 may then utilize the separate pneumatic control 104 to control a position of the actuator assembly 108. The example wireless position monitor 200 is incapable of directly controlling the actuator assembly 108 to which it is mounted.

Figure 3A:
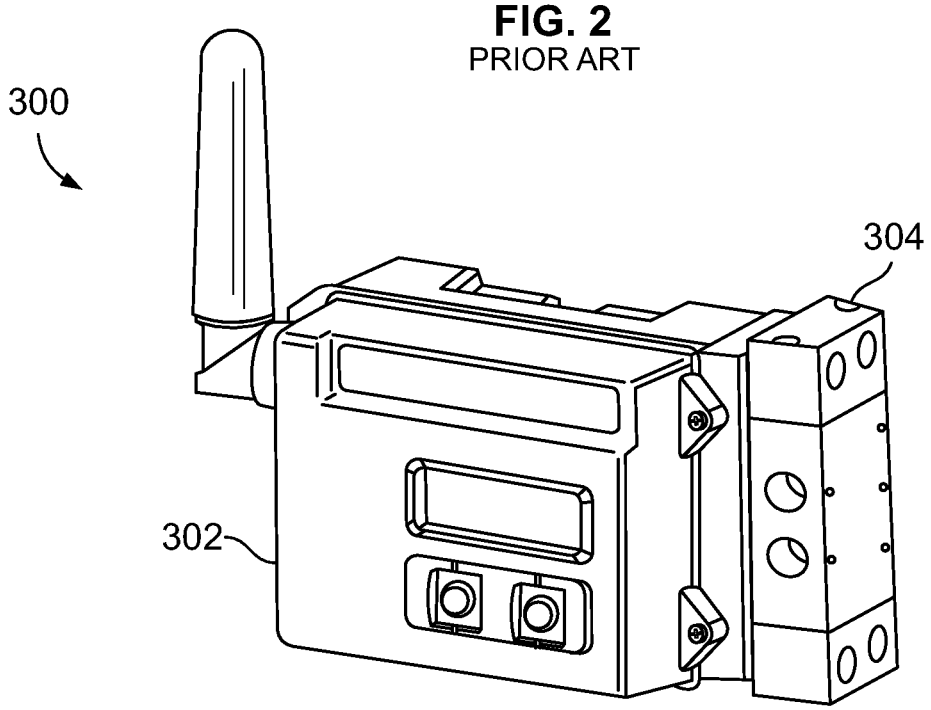
FIG. 3A illustrates an example wireless pneumatic controller as described herein.

FIG. 3A illustrates an example wireless pneumatic controller 300 as described herein. The example wireless pneumatic controller 300 includes a housing 302 that contains a position monitor having a wireless communication interface. The housing 302 may be operatively coupled to an actuator assembly, for example, the actuator assembly 108 of FIG. 1, to enable the pneumatic controller 300 to receive position information of the actuator assembly 108. The example wireless pneumatic controller 300 may be mounted on, for example, a rotary valve or a sliding stem valve to collect valve position information. The example pneumatic controller 300 may wirelessly transmit the position information of the actuator assembly 108 to a control system, for example, the control system 102 of FIG. 1.

The control system 102 may then send a command to the example pneumatic controller 300 to control the positioning of the actuator assembly 108. The example pneumatic controller 300 includes a pneumatic control module 304 to convert the command into a pneumatic signal to control the actuator assembly 108. Thus, the example pneumatic controller 300 is capable of collecting and relaying position information and directly controlling the actuator assembly 108.

The example pneumatic controller 300 may be in communication with the control system 102 of FIG. 1 as described above. This communication allows the control system 102 to control the actuator assembly 108 as part of a larger processing system, for example, a system with multiple actuator assemblies. In an alternative example, the example pneumatic controller 300 may contain an individual processing unit to control the actuator assembly 108 without communicating with the control system 102.

Additionally, the example wireless pneumatic controller 300 may be converted from a pneumatic controller to a position monitor to suit the needs of a particular application. The pneumatic control module 304 may be removed from the housing 302 to allow the pneumatic controller 300 to operate only as a wireless position monitor. Further, the modularity of the example pneumatic controller 300 enables the pneumatic control module 304 to be separated from the actuator assembly 108 to facilitate maintenance or service of the pneumatic controller 300.

In an alternative example, the wireless pneumatic controller 300 may be contained or integrated within one housing 302 such that the pneumatic control module 304 may not be removed from the pneumatic controller 300.

Figure 3B:
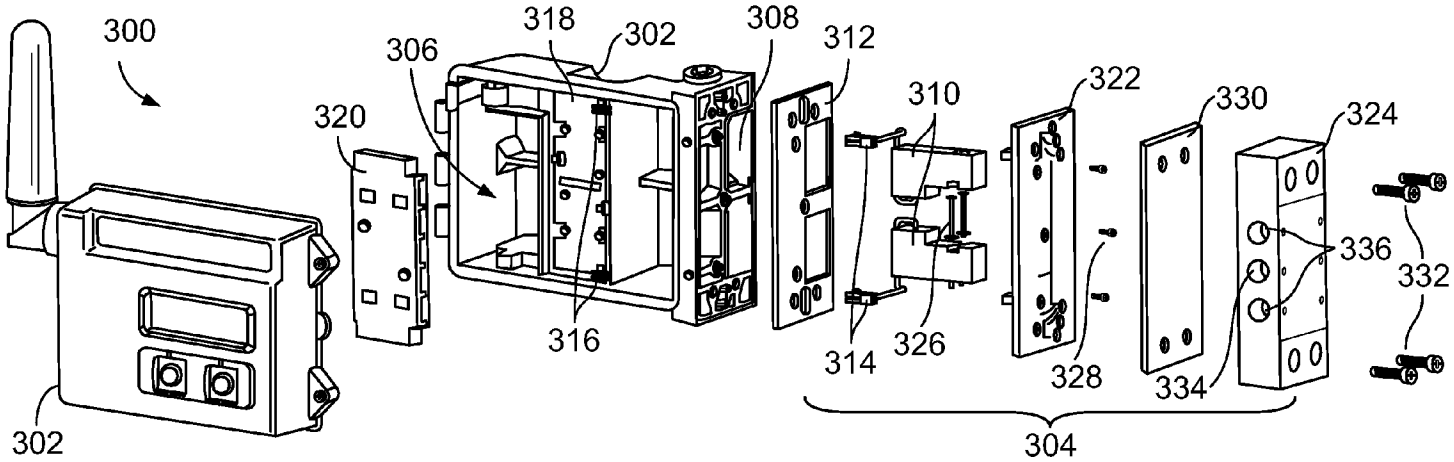
FIG. 3B illustrates a partially exploded assembly view of the example wireless pneumatic controller of FIG. 3A.
Figure 3C:
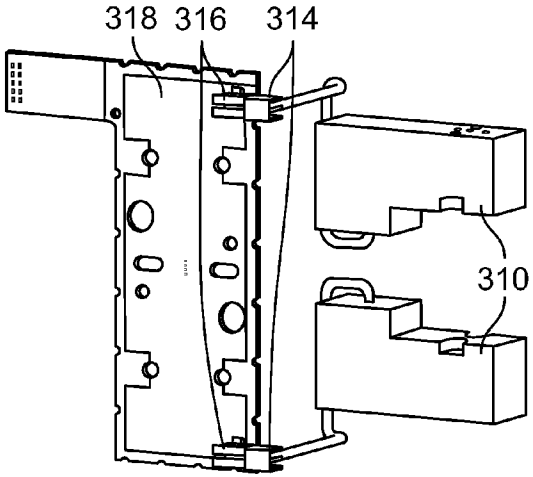
FIG. 3C illustrates pneumatic converters coupled to a printed circuit board via wired connectors of the example wireless pneumatic controller of FIG. 3A.

FIG. 3B illustrates a partially exploded assembly view of the example wireless pneumatic controller 300 of FIG. 3A. The housing 302 contains a wireless position monitor 306 to collect and relay position information of the actuator assembly 108 to the control system 102 of FIG. 1. Additionally, the wireless position monitor 306 receives electronic commands from the control system 102. The housing 302 of the example wireless pneumatic controller 300 includes an opening 308 to receive the pneumatic control module 304.

The pneumatic control module 304 includes two pneumatic converters 310 to be placed in the opening 308 of the housing 302 through a gasket 312. The gasket 312 provides a seal between the internal components of the pneumatic control module 304 and the ambient environment of the pneumatic controller 300. The pneumatic converters 310 are operatively connected to the pneumatic controller 300 using two wired connectors 314. The wired connectors 314 utilize male connectors that are received by (i.e., plugged into) female connector counterparts 316 attached to a printed circuit board 318 contained within the housing 302. The circuit board 318 operates to enable each pneumatic converter 310 to be controlled independently. An electromagnetic interference shield 320 covers the circuit board 318 when the pneumatic controller 300 is assembled. The female connector counterparts 316 on the circuit board 318 may be accessed without removing the shield 320.

The pneumatic converters 310 convert an electronic command (e.g., a voltage, a current, etc.) received by the wireless position monitor 306 from the control system 102 to a pneumatic signal (e.g., a proportional pressure value). The pneumatic converters 310 may be, for example, a piezoelectric pilot valve or a solenoid pilot valve. Two pneumatic converters 310 are used to enable the pneumatic controller 300 to control both the open and closed positions of the actuator assembly 108 of FIG. 1.

The pneumatic control module 304 includes a pneumatic control module base 322 to operatively connect the pneumatic converters 310 to a pneumatic amplifier, in this example, a spool valve 324. The pneumatic control module base 322 is a pneumatic manifold to seal and route the pneumatic signal created by the pneumatic converters 310 to the spool valve 324. The pneumatic converters 310 are attached to the base 322 using fasteners 326. Fasteners 328 are used to connect the base 322 to the housing 302. A gasket 330 is placed between the base 322 and the spool valve 324. Fasteners 332 are placed into the spool valve 324 to connect the pneumatic control module 304 to the housing 302 of the pneumatic controller 300. The fasteners 326, 328, and 332 may be, for example, screws or any other hardware device capable of connecting the pneumatic control module 304 to the housing 302.

The pneumatic control module 304 includes the spool valve 324 to pneumatically control the actuator assembly 108 of FIG. 1. The spool valve 324 receives the pneumatic signal from the pneumatic converters 310 via the base 322 and amplifies the pneumatic signal. In this example, the spool valve 324 is used to pneumatically control the actuator assembly 108. However, any other pneumatic amplifier may be used to amplify the pneumatic signal from the pneumatic converters 310 and control the actuator assembly 108, for example a poppet valve, a pneumatic diaphragm valve or a pneumatic relay valve. The spool valve 324 includes a supply port 334 and two exhaust ports 336. The exhaust ports 334 and 336 may be threaded to enable the pneumatic controller 300 to be coupled to the actuator assembly 108 via, for example, tubing. The spool valve 324 is used to control a position of the actuator assembly 108 according to the received command.

In the example of FIG. 3B, the wireless pneumatic controller 300 may operate as described above to directly control the pneumatic devices of a valve/actuator assembly or, alternatively, may be used primarily as a wireless position monitor by removing the pneumatic control module 304 from the pneumatic controller 300 as described below in FIGS. 4A-4B.

Figure 4A:
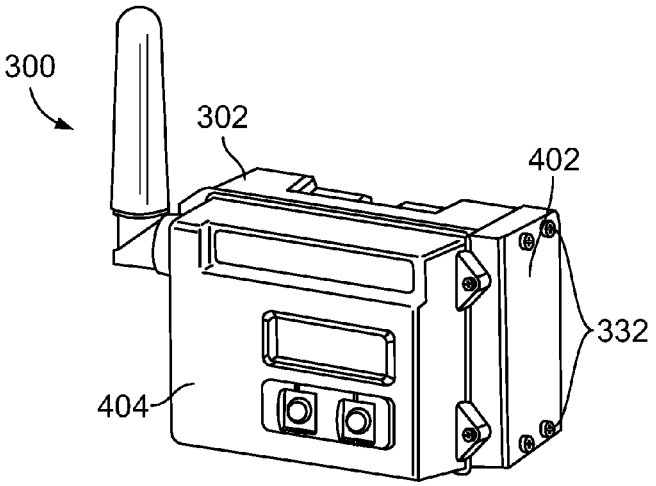
FIG. 4A illustrates the example wireless pneumatic controller of FIG. 3A with a pneumatic control module removed.

FIG. 4A illustrates the example wireless pneumatic controller 300 of FIG. 3A with the pneumatic control module 304 removed. A removable cover 402 is attached to the housing 302 where the pneumatic control module 304 was located in FIG. 3A to allow the pneumatic controller 300 to operate primarily as a wireless position monitor. The pneumatic control module 304 of FIG. 3A is removed by removing the fasteners 332 and removing (i.e., unplugging) the wired connectors 314 from the female connector counterparts 316 on the circuit board 318. The female connector counterparts 316 are accessed by removing or opening a front cover 404 of the housing 302.

Figure 4B:
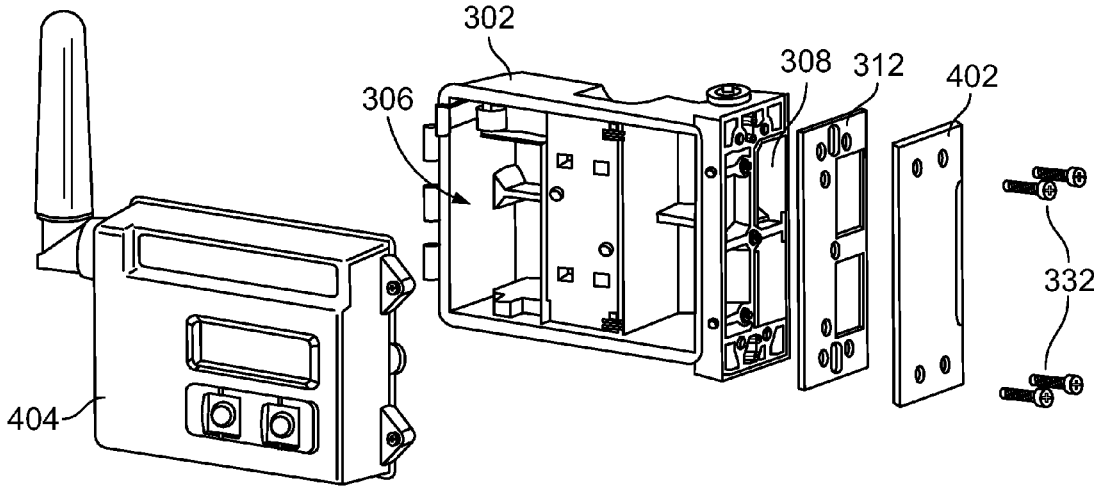
FIG. 4B illustrates a partially exploded assembly view of the example wireless pneumatic controller of FIG. 4A.

FIG. 4B illustrates a partially exploded assembly view of the example wireless pneumatic controller 300 of FIG. 3A with the pneumatic control module 304 removed. The housing 302 contains the wireless position monitor 306 of FIG. 3A to collect and relay position information of the actuator assembly 108 to the control system 102 of FIG. 1. The front cover 404 is replaced on the housing 302 once the pneumatic control module 304 is removed. The gasket 312 is placed between the opening 308 of the housing 302 and the removable cover 402, and the cover 402 is attached to the housing using the fasteners 332.

Figure 5:
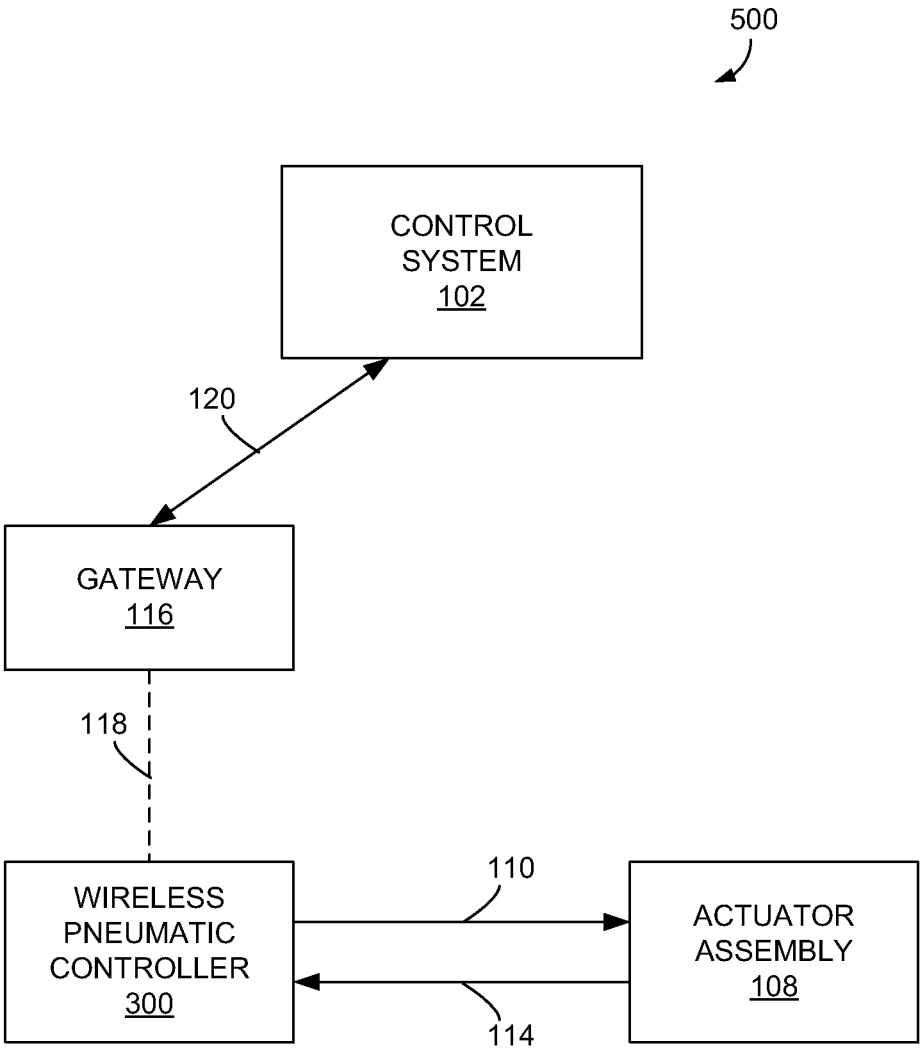
FIG. 5 illustrates an example block diagram of an actuator control system implementing the example wireless pneumatic controller of FIG. 3A.

FIG. 5 illustrates an example block diagram of an actuator control system 500 implementing the example wireless pneumatic controller 300 of FIG. 3A. As the actuator assembly 108 operates, the pneumatic controller 300 monitors a position of the actuator assembly 108 by receiving the feedback signal 114 indicating the position of the actuator assembly 108. The pneumatic controller 300 communicates the position information to the gateway 116 via the wireless communication link 118. The position information is then communicated from the gateway 116 to the control system 102 via the wired path or link 120. The control system 102 sends electrical commands to the pneumatic controller 300 via the wired path or link 120 and the wireless communication link 118. The pneumatic controller 300 directly controls the actuator assembly 108 by converting the electrical commands into the pneumatic signal 110. Thus, in the example of FIG. 5, the control system 102 needs to communicate only with the pneumatic controller 300 of FIG. 3A to both collect and relay position information and to directly control the actuator assembly 108.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A pneumatic controller comprising:

a housing to be connected to an actuator and defining an opening;

a position monitor contained in the housing and including a wireless communication interface;

a gasket to seal the position monitor in the housing;

a pneumatic control module detachably connected to the housing and including a pneumatic converter; and a wired connector coupled to the pneumatic converter, the wired connector and the pneumatic converter are to extend through the gasket and the opening of the housing to operatively couple the pneumatic control module and the position monitor.

2. The pneumatic controller of claim 1, further comprising a cover to be connected to the housing via the gasket to cover the opening when the pneumatic control module is detached from the housing.

3. The pneumatic converter of claim 2, further comprising fasteners to connect at least one of the pneumatic control module and the cover to the housing.

4. The pneumatic controller of claim 1, wherein the position monitor is to monitor a position of the actuator.

5. The pneumatic controller of claim 4, wherein the pneumatic controller is to provide the position of the actuator to a control system via the wireless communication interface.

6. The pneumatic controller of claim 5, wherein the pneumatic controller is to receive a command from the control system via the wireless communication interface.

7. The pneumatic controller of claim 6, wherein the pneumatic control module is to convert the command into a pneumatic signal.

8. The pneumatic controller of claim 7, wherein the pneumatic controller is to control the position of the actuator using the pneumatic signal.

9. A pneumatic control module comprising:

a pneumatic converter detachably couplable to a position monitor contained within a housing having a wireless communication interface, the pneumatic converter and a wired connector coupled to the pneumatic converter are to extend through an opening of the housing to couple the pneumatic converter to the position monitor, the pneumatic converter is to convert a signal received by the wireless communication interface into a pneumatic signal;

a pneumatic amplifier to amplify the pneumatic signal to control an actuator; and a pneumatic manifold coupled to the pneumatic converter and the housing to route the pneumatic signal from the pneumatic converter to the pneumatic amplifier.

10. The pneumatic control module of claim 9, wherein the pneumatic converter comprises at least one of a piezoelectric pilot valve or a solenoid pilot valve.

11. The pneumatic control module of claim 9, wherein the pneumatic amplifier includes at least one of a spool valve, poppet valve, pneumatic diaphragm valve, or a pneumatic relay valve.

12. The pneumatic control module of claim 9, wherein the pneumatic amplifier is to amplify the pneumatic signal to control a position of the actuator.

13. The pneumatic control module of claim 9, further comprising a gasket disposed between the pneumatic manifold and the pneumatic amplifier.

14. The pneumatic control module of claim 9, further including a first fastener to couple the pneumatic manifold to the pneumatic converter and a second fastener to couple the pneumatic manifold to the housing.

15. A pneumatic controller comprising:

a housing to be operatively coupled to an actuator and defining an opening;

a position monitor contained within the housing and having a wireless communication interface, the position monitor is to collect position information to monitor a position of the actuator; and a pneumatic control module coupled to the housing, the pneumatic control module includes a pneumatic converter and a wired connector coupled to the pneumatic converter that are to extend through the opening of the housing to operatively couple the pneumatic control module and the position monitor, the pneumatic control module is to receive a command signal to control the position of the actuator, wherein the wireless communication interface of the housing wirelessly communicates the position information of the position monitor and the command signal of the pneumatic control module.

16. The pneumatic controller of claim 15, wherein the pneumatic controller is to provide the position information of the actuator to a control system via the wireless communication interface.

17. The pneumatic controller of claim 16, wherein the pneumatic controller is to receive the command signal from the control system via the wireless communication interface.

18. The pneumatic controller of claim 17, wherein the pneumatic control module is to convert the command signal into a pneumatic signal.

19. The pneumatic controller of claim 18, wherein the pneumatic controller is to control the position of the actuator using the pneumatic signal.

* * * * *